US005291876A

United States Patent [19]

Milstead

[11] Patent Number: 5,291,876

[45] Date of Patent: Mar. 8, 1994

[54] FEED HOPPER FOR PROVIDING PREHEATED AGGREGATE MATERIAL

[75] Inventor: John Milstead, Chattanooga, Tenn.

[73] Assignee: Astec Industries, Inc., Chattanooga, Tenn.

[21] Appl. No.: 772,426

[22] Filed: Oct. 7, 1991

[51] Int. Cl.[5] ..... E01C 19/45

[52] U.S. Cl. ..... 126/343.5 A; 404/95; 432/102

[58] Field of Search ..... 126/343.5 A, 391, 343.5 R; 34/170; 222/146.2, 146.5; 432/97, 102; 404/79, 91, 95, 110; 366/25

[56] References Cited

U.S. PATENT DOCUMENTS

| | | | |
|---|---|---|---|
| 614,198 | 11/1898 | Boorman et al. | 126/343.5 R X |
| 1,084,732 | 1/1914 | Dennis | 404/79 X |
| 2,481,199 | 9/1949 | Cayas | 126/343.5 R X |
| 2,857,155 | 10/1958 | Dickey | 432/102 X |
| 2,977,955 | 4/1961 | Altenburg | 126/343.5 R |
| 3,025,043 | 3/1962 | Ruelle et al. | 432/102 |
| 3,502,245 | 3/1970 | Hoffstetter | 126/343.5 A X |
| 3,577,976 | 5/1971 | Heller . | |
| 3,659,583 | 5/1972 | Martin . | |
| 3,757,745 | 9/1973 | Miller . | |
| 3,802,847 | 4/1974 | Hara et al. . | |
| 3,814,406 | 6/1974 | Shimizu et al. . | |
| 4,172,445 | 10/1979 | Sellers . | |
| 4,387,996 | 6/1983 | Mendenhall . | |
| 4,398,826 | 8/1983 | Mendenhall . | |
| 4,427,376 | 1/1984 | Etnyre et al. . | |
| 4,445,848 | 5/1984 | Heller . | |
| 4,617,744 | 10/1986 | Siddoway et al. | 432/102 X |
| 5,101,806 | 4/1992 | Hunt et al. | 126/343.5 R X |
| 5,120,217 | 6/1992 | O'Brien et al. | 126/343.5 R X |

FOREIGN PATENT DOCUMENTS

| | | | |
|---|---|---|---|
| 47681 | 11/1888 | Fed. Rep. of Germany | 126/343.5 A |
| 0668995 | 6/1979 | U.S.S.R. | 366/25 |

*Primary Examiner*—Carl D. Price
*Attorney, Agent, or Firm*—Nilles & Nilles

[57] ABSTRACT

An apparatus for feeding preheated aggregate material, such as for the production of asphalt. A feed hopper includes a heater within its interior and positioned adjacent a slotted discharge opening at the lower end of the hopper. A tent-like cover is positioned above the heater to deflect aggregate material from contacting the upper portion of the heater and to transfer heat to the aggregate material in a uniform and efficient manner. The heater may preferably be a gas-fired radiant heater extending lengthwise parallel to and for the full length of the slotted discharge opening. A series of hoppers may be arranged in side-by-side relation and a common conveyor positioned beneath the individual feed conveyors of each hopper to direct the preheated aggregate material to a subsequent processing apparatus, such as a drum mixer or other dryer, used for the production of asphalt.

13 Claims, 2 Drawing Sheets

FEED HOPPER FOR PROVIDING PREHEATED AGGREGATE MATERIAL

FIELD OF THE INVENTION

The present invention relates to feed hoppers for providing aggregate material, such as for the production of asphalt, and, more particularly, to a feed hopper for preheating the aggregate material to be discharged from the hopper.

BACKGROUND OF THE INVENTION

The raw materials for the production of asphalt, such as virgin aggregate or recycled asphalt pavement (RAP), are typically loaded from outdoor stockpiles into a plurality of individual hoppers and fed therefrom to a conveyor and then into a drum mixer. The drum mixer removes moisture and heats the aggregate. The heated aggregate may be coated with liquid asphalt either in the mixer or in a separate mixing chamber or pugmill.

In a typical mixer, wet aggregate enters the drum and is picked up and dropped through the hot gases and gradually cascades from one end of the drum to the other. The dwell time for material in the drum typically varies from as short as two minutes to as long as six minutes. The raw materials must absorb a relatively large amount of heat from the drum mixer for a satisfactory final product.

Since the moisture content of the raw materials affects the amount of heat that must be absorbed in the drum mixer, an effort is typically made to manage the stockpiles of raw materials to reduce moisture. Raw materials may be taken from the sections of the outdoor stockpiles which have benefitted most from drainage and natural heating and drying. For example, the moisture level for a typical aggregate material varies according to height above the ground surface with the material adjacent the ground having the highest moisture content. Therefore, a loader operator may be instructed to remove material from above the 3' level, for example. In addition, the stockpile may be positioned on a slight incline and the loader operator may also be instructed to remove material from the sunny side of the stockpile. Stockpiles may also be covered to reduce their moisture content. As disclosed in *Productivity: "Producing Profits for the '80s"*, by J. Don Brock, Technical Bulletin No. T-106, 1984, it has been suggested that rising fuel prices may make it desirable to heat stockpiles with forced hot air generated by a water heat exchange system coupled to the exhaust gases from the baghouse of a typical asphalt plant.

Heating of raw materials is used in many different processes of a typical asphalt plant. For example, U.S. Pat. No. 4,172,445 to Sellers discloses a heater provided for a storage tank for the storage of fluids, such as asphalt or hot water. The oil fired burner is fitted into a flue container of a ceramic combustion chamber which has a thick wall and serves to shield the outside of the flue from overheating the asphalt for the length of the ceramic chamber. Similarly, U.S. Pat. No. 3,757,745 to Miller discloses dual extending heat exchangers positioned within a storage tank for asphalt or other liquids.

U.S. Pat. No. 3,659,583 to Martin is directed to maintaining the aggregate material in a storage bin free from a light freeze or frost condition. Martin discloses passing heated air through jackets on the walls of the bins to heat the aggregate only to an increment above the freezing point of water. The Martin patent teaches that it is not feasible to pass steam through the aggregate since the condensed steam thoroughly soaks the mass. On the other hand, if dry, flue gases from a heat generator are passed through the aggregate, contamination may result which is equally as unacceptable as steam soaking.

U.S. Pat. No. 4,387,996 to Mendenhall discloses a batch plant using the Minnesota Heat Transfer Method of Recycling, in which a small amount of preheat is given to the RAP in a separate drum where the RAP is in direct contact with the combustion gases in order to reduce the amount of super heat required for mixing with the virgin aggregate material in the drum mixer.

SUMMARY OF THE INVENTION

It is therefore an object of the present invention to provide an apparatus for preheating aggregate material in order to reduce the amount of heat it must later absorb in a drum mixer or other drying device.

It is another object of the invention to provide a heater for a feed hopper which efficiently provides heat to a portion of the aggregate material just prior to discharge from the hopper.

It is still another object of the invention to provide a heater for a feed hopper which does not overheat aggregate material in contact therewith.

These and other objects are provided by an apparatus which includes a feed hopper having opposing upper and lower ends. The upper end of the hopper is open for receiving a load of aggregate material, such as virgin aggregate or RAP, from a stockpile of the material. The hopper may have rectangularly shaped inclined walls which form a progressively narrower cross-section from the upper end to the lower end. The lower end of the feed hopper also has a discharge opening for the aggregate material. The quantity of material flowing through the discharge opening is preferably controlled by a gate positioned adjacent the discharge opening.

A heater is positioned within the hopper adjacent the lower end to preheat the aggregate material in the lower end before the material passes through the discharge opening. The heater is preferably a radiant gas-fired heater. For a rectangularly shaped hopper, the discharge opening may be a rectangular slot. Thus, the heater is preferably positioned within the hopper and extends lengthwise generally parallel to and along substantially the full length of the slot.

A cover is preferably positioned in the hopper in a spaced-apart relation above the heater to deflect aggregate material moving past the heater from contacting an upper portion of the heater. The cover may preferably be an elongate folded sheet of thermally conductive material having an overall tent like appearance. The cover absorbs radiant heat from the heater and transfers the heat to the aggregate material passing over the cover by conduction. The cover serves to spread the heat over a larger surface area of the aggregate material to thereby avoid undesirable hot spots from adversely effecting the aggregate material.

Means, such as a vent pipe, may be provided for venting exhaust gases from the gas-fired heater to an area outside of the hopper. Alternately, the exhaust gases may be permitted to percolate through the aggregate material.

A conveyor may be provided immediately below the discharge opening for each hopper, to carry the aggregate material to another location for further processing, such as to a drum mixer. A conventional clam gate may be provided adjacent the discharge opening to control the flow of aggregate from the hopper. If a series of hoppers are arranged in a row, each of the individual conveyors may feed their respective aggregate materials onto a common conveyor. The common conveyor may then carry the preheated aggregate material to a drum mixer or other type heater for further processing. While the feed hopper and heater of the present invention have particular application for the production of asphalt as highlighted herein, it would be readily understood by those skilled in the art that the present invention may similarly be used in many other industrial material processing operations.

DETAILED DESCRIPTION OF THE PREFERRED EMBODIMENT OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein; rather, applicant provides this embodiment so that this disclosure will be thorough and complete, and will fully convey the scope of the invention to those skilled in the art. Like numbers refer to like elements throughout.

Figure 1:
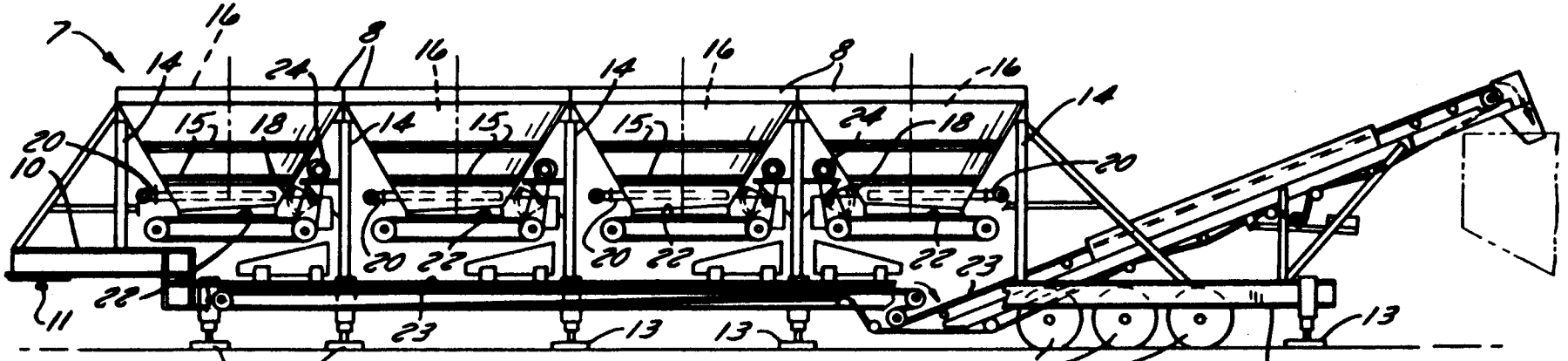
FIG. 1 is a side elevational view of a feed hopper system including a plurality of individual feed hoppers for preheating aggregate material according to the present invention.
Figure 2:
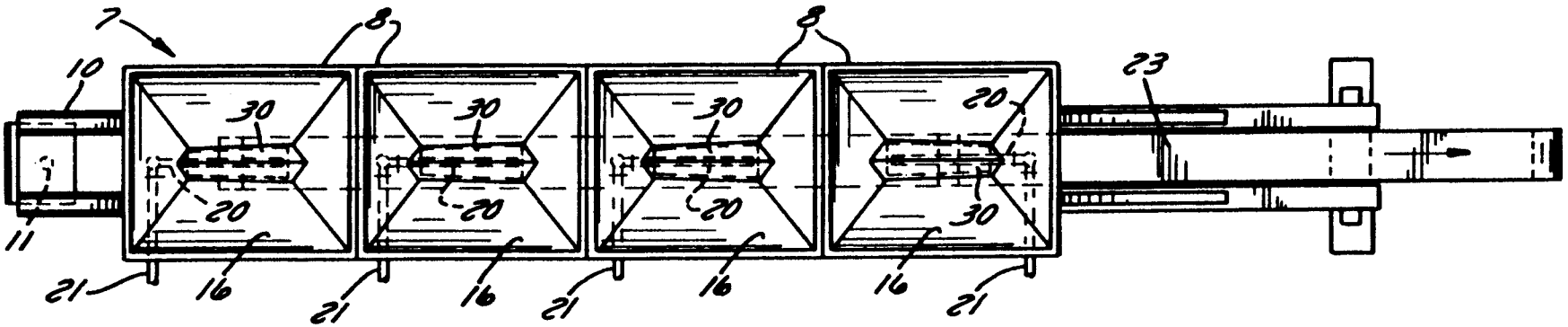
FIG. 2 is a plan view of the feed hopper system illustrated in FIG. 1.

Referring to FIGS. 1 and 2, there is shown a stationary feed hopper system according to the present invention generally designated as 7. The system 7 includes a plurality of individual gravity feed hoppers 8 which are loaded with aggregate material 9 (FIGS. 3–5), such as for the production of asphalt, from one or more stockpiles of material, not shown. While the feed hopper system 7 of the present invention is described particularly with respect to asphalt production, it would be understood by those skilled in the art that the system may be readily used for preheating other raw materials for other industrial and commercial processes.

The hoppers 8 are arranged in a side-by-side relation on a highway transportable frame 10, which includes a fifth wheel hitch 11 at the forward end and three wheel assemblies 12 mounted in tandem at the rear end. Also, a plurality of footers 13 are provided along the length of the frame 10 to support the vertical support posts 14. The hoppers 8 are positioned between the vertical support posts 14, and each hopper includes horizontal reinforcing braces 15 for added strength. In addition, separation partitions, not shown, may be positioned between adjacent hoppers 8 and extending thereabove to prevent spillover of aggregate material 9 between adjacent hoppers 8. Each of the hoppers 8 includes an open generally rectangular upper end 16 adapted for receiving the load of aggregate 9 from the stockpile. Each of the hoppers 8 also includes a lower discharge opening 17 of elongate rectangular outline (FIG. 5) for releasing the aggregate material 9 from the hopper 8. The hoppers s have inclined walls which define a progressively smaller rectangular cross-section proceeding from the top to the bottom of the hopper 8.

Figure 3:
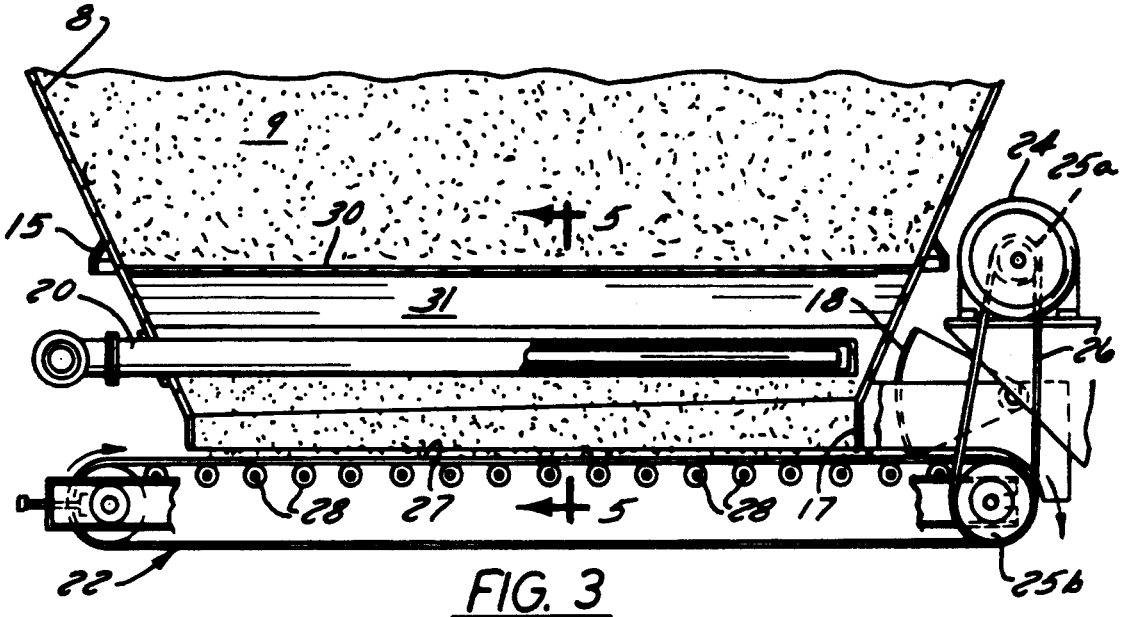
FIG. 3 is an enlarged fragmentary side elevational view of an individual feed hopper as shown in FIG. 1.
Figure 4:
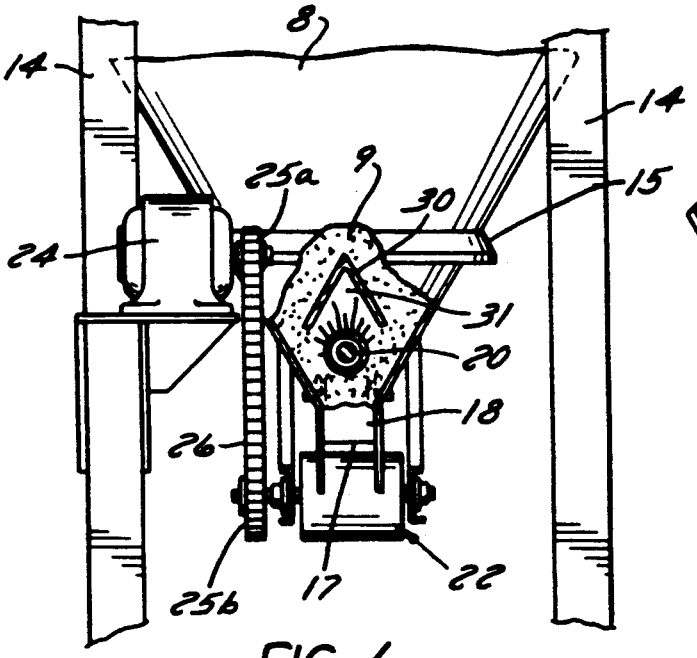
FIG. 4 is a fragmentary end view of the feed hopper shown in FIG. 3.
Figure 5:
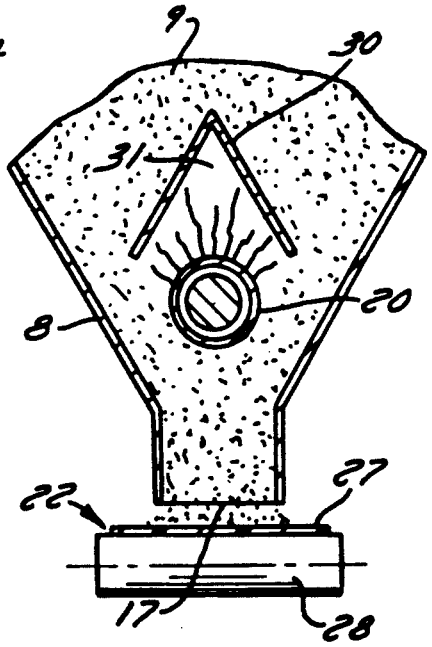
FIG. 5 is a cross-sectional view of the feed hopper shown in FIG. 3 along section lines 5—5.

Referring to FIGS. 3–5, a heater 20 is positioned within the interior of a hopper 8 adjacent the lower end of the hopper. The heater 20 may preferably be a radiant gas-fired heater supplied with gas via a gas line 21 (FIG. 2) from a natural gas source, not shown. For a rectangular or slotted discharge opening 17 as illustrated, the heater 20 preferably comprises a lengthwise extending elongate heater positioned parallel to and immediately above the discharge opening 17 and it has a length sufficient to extend along substantially the entire length of the opening 17.

The heater 20 may preferably be a ceramic fiber matrix burner having reduced $NO_x$ emissions and having a high burner efficiency by using a radiant ceramic surface as the heat source. Combustion in the heater is virtually noiseless and the heater produces substantially uniform heat along its length. Exhaust gases from the heater 20 may be allowed to percolate through the aggregate material 9 or may be vented by means such as a vent pipe (not shown) extending to outside of the hopper 8. The heater 20 may be of the type developed by Alzetta Corporation under contract to the Gas Research Institute (GRI) for which further information may be obtained by contacting Thermal Systems, at GRI, 8600 West Bryn Mawr, Chicago, Ill. 60631.

An individual hopper conveyor 22 is positioned beneath each of the hoppers 8 to receive the preheated aggregate material 9 therefrom and carry it to a common conveyor 23. The common conveyor 23 may include an inclined portion to carry the preheated aggregate material 9 to a drum mixer or other dryer, not shown. The hopper conveyor 22 includes a conveyor belt 27 and underlying rollers 28 operated by drive means, such as an electric motor 24 and its associated pulleys 25*a*, 25*b* and drive belt 26.

A single clam gate 18 of conventional design is positioned adjacent the discharge opening 17 of the hopper 8 to control the amount of aggregate material 9 discharged from the hopper 8. The clam gate 18 may be raised or lowered and the speed of the individual hopper conveyor 22 varied to adjust the feed rate of aggregate material 9 from the hopper 8.

The location of the heater 20 within the lower end of the hopper 8 means that the heat does not have to penetrate very far into the aggregate material 9 while still providing sufficient preheating of the aggregate material 9 being delivered from the hopper 8. The heat absorbed by the material 9 may be controlled by correlating operation of the heater 20 with movement of the aggregate 9 through the discharge opening 17 and along the individual hopper conveyor 22 during either batch or continuous operation. In this manner the aggregate material 9 is exposed to heat for only a relatively short time so that the temperature is not raised above a predetermined level.

For a batching operation for example, if the individual hopper conveyor 22 stops for more than a predetermined time, such as two minutes, the heater 20 may be turned off. Thus, a quantity of the material 9 accumulates heat energy, is withdraw in a slug and is replaced with a new quantity of material 9 which will then absorb heat energy from the heater 20. Alternately, the heater 20 may be cycled on and off at full capacity until a predetermined preheating temperature of the aggregate material 9 is reached.

To provide more even heat distribution to the aggregate material 9, an elongate cover 30 is preferably provided above the full length of the heater 20. It is desirable to evenly heat the aggregate material 9 without overheating. Overheating may cause undesirable effects on the aggregate 9, such as separation of mixtures and emulsions, distillation of product, coking changes in viscosity and characteristics of the material in storage, as well as deterioration of the heater 20 or cover 30 surface themselves, such as pitting and corrosion.

In the illustrated embodiment, the cover 30 comprises a folded sheet of thermally conductive material, such as a metal, positioned in a spaced-apart relation above the heater 20. Described another way, the cover 30 may have a tent-shaped appearance which creates a cavity 31 (FIG. 5) in the moving aggregate material 9 above the heater 20. The cover 30 shields an upper portion of the heater 20 from direct contact with the moving aggregate material 9. The cover 30 thus serves to distribute the heat absorbed from the radiant heater 20 to a larger surface area to then be transferred to the adjacent aggregate material 9 by conduction.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus for feeding preheated aggregate material, comprising:

a feed hopper having opposite upper and lower ends, said upper end being open and adapted to receive aggregate material therein, said lower end having a rectangular lengthwise extending discharge opening adapted to feed aggregate material therethrough;

an elongate gas fired radiant surface heater having an upper portion and a lower portion, said heater positioned within said hopper adjacent said lower end and adapted for preheating aggregate material prior to the aggregate material passing through said discharge opening, said heater extending lengthwise generally parallel to and above said opening and for substantially the full length of said opening; and a cover positioned above and in spaced-apart relation from said heater and adapted for shielding the upper portion of said heater from direct contact with aggregate material, said cover, said heater, and said lower end of said hopper being dimensioned and positioned so as to allow the lower portion to have direct contact with aggregate material moving past said heater and toward said discharge opening.

2. The apparatus according to claim 1 wherein said cover comprises an elongate folded thermally conductive metal sheet adapted for transferring heat absorbed from said heater to aggregate material passing over the folded metal sheet.

3. The apparatus according to claim 1 wherein said feed hopper has four inclined walls forming a substantially rectangular cross-sectional area progressively decreasing from said upper end to said lower end.

4. The apparatus according to claim 1 further comprising a conveyor positioned immediately below said discharge opening and adapted for transporting aggregate material from said hopper.

5. The apparatus according to claim 3 further comprising gate means positioned adjacent said discharge opening and said conveyor and adapted for controlling the flow of aggregate material from said hopper.

6. An apparatus for feeding aggregate material, comprising:

a plurality of generally upright hoppers arranged in a row, each of said hoppers having opposing upper and lower ends, each of said upper ends being open and adapted to receive aggregate material therein, each of said lower ends having a discharge opening adapted to feed aggregate material therethrough;

a heater positioned within a respective one of said hoppers adjacent said lower end thereof and adapted for preheating aggregate material prior to the aggregate material passing through said discharge opening; and common collecting conveyor positioned below all of said hoppers and adapted to receive thereon the preheated aggregate material from said hoppers.

7. The apparatus according to claim 5 further comprising a cover positioned above and in a spaced-apart relation from a respective one of each of said heaters and adapted for shielding an upper portion thereof from direct contact with aggregate material moving past said heater and toward said discharge opening.

8. The apparatus according to claim 6 wherein each of said covers comprises an elongate folded thermally conductive metal sheet adapted for transferring heat absorbed from a respective one of said heaters to aggregate material passing over the folded metal sheet.

9. The apparatus according to claim 5 further comprising an individual conveyor positioned adjacent a respective one of said discharge openings and adapted for transporting aggregate material from each of said hoppers to said common collecting conveyor.

10. The apparatus according to claim 5 wherein each of said heaters comprises a gas-fired radiant heater.

11. The apparatus according to claim 9 wherein each of said discharge openings is a rectangular lengthwise extending slot, and wherein each of said heaters extends lengthwise generally parallel to and for substantially the full length of said respective slots.

12. The apparatus according to claim 5 wherein each of said feed hoppers has four inclined walls forming a substantially rectangular cross-sectional area progressively decreasing from said upper end to said lower end.

13. The apparatus according to claim 5 further comprising gate means positioned adjacent a respective one of said discharge openings and adapted for controlling the flow of aggregate material therefrom.

* * * * *